United States Patent [19]

Wernicke et al.

[11] Patent Number: 5,006,439

[45] Date of Patent: Apr. 9, 1991

[54] PHOTOGRAPHIC REVERSAL PROCESS USING A COLOR DEVELOPING AGENT IN THE BLACK-AND-WHITE DEVELOPER

[75] Inventors: Ubbo Wernicke, Cologne; Herbert Mitzinger, Lindlar-Remshagen, both of Fed. Rep. of Germany

[73] Assignee: Agfa-Gevaert Aktiengesellschaft, Leverkusen, Fed. Rep. of Germany

[21] Appl. No.: 434,414

[22] Filed: Nov. 13, 1989

[30] Foreign Application Priority Data

Nov. 24, 1988 [DE] Fed. Rep. of Germany ..... 3839573

[51] Int. Cl.[5] ..... G03C 5/50; G03C 7/30

[52] U.S. Cl. ..... 430/379; 430/407; 430/409; 430/434; 430/435; 430/442; 430/464

[58] Field of Search ..... 430/379, 407, 409, 434, 430/435, 442, 464

[56] References Cited

U.S. PATENT DOCUMENTS

| | | | |
|---|---|---|---|
| 3,658,525 | 4/1972 | Bent et al. | 430/379 |
| 3,658,535 | 4/1972 | Willems | 430/407 |
| 3,883,354 | 5/1975 | Molenda | 450/379 |
| 4,004,926 | 1/1977 | Willems et al. | 430/379 |
| 4,184,875 | 1/1980 | Odenwälder et al. | 430/379 |
| 4,299,913 | 11/1981 | Wernicke | 430/379 |
| 4,394,440 | 7/1983 | Cappel | 430/379 |

FOREIGN PATENT DOCUMENTS

| | | | |
|---|---|---|---|
| 2278097 | 3/1976 | France | 430/379 |
| 2278098 | 3/1976 | France | 430/379 |
| 73035 | 6/1979 | Japan | 430/407 |

OTHER PUBLICATIONS

RD 12839, "Method of Producing Reversal Color Images," 12/74.

RD 15854, "Method for Forming Reversal Color Images," 6/77.

*Primary Examiner*—Charles L. Bowers, Jr.
*Assistant Examiner*—Patrick A. Doody
*Attorney, Agent, or Firm*—Connolly and Hutz

[57] ABSTRACT

A photographic reversal process for the production of positive photographic images by imagewise exposure of the photosensitive material containing at least one silver halide emulsion layer, black-and-white first development of the material, chemical fogging, color development and bleaching, fixing, washing or stabilizing and drying, in which the material is transferred from the first development to the color development without any intermediate steps, such as intermediate washing or diffuse second exposure, the first development bath exclusively contains one or more N,N-dialkyl-p-phenylenediamine derivatives as developer and a tin(II) complex compound and is adjusted to a pH value of $<8$ and the color development bath likewise exclusively contains one or more N,N-dialkyl-p-phenylenediamine derivatives as developer and is adjusted to a pH value $>10$, requires considerably less time than the conventional process but produces equivalent results.

8 Claims, No Drawings

PHOTOGRAPHIC REVERSAL PROCESS USING A COLOR DEVELOPING AGENT IN THE BLACK-AND-WHITE DEVELOPER

This invention relates to a process for processing photographic reversal materials which is of considerably shorter duration than conventional processes.

In the photographic reversal process, a positive colored image is produced using a color transparency by exposure of a negatively working color reversal paper by a special reversal development. The color reversal paper comprises at least one blue-sensitive silver halide layer containing a yellow coupler, at least one green-sensitive silver halide layer containing a magenta coupler and at least one red-sensitive silver halide layer containing a cyan coupler.

Typical reversal processing by the chromogenic color process comprises at least six steps, namely:

First development black-and-white negative development. The silver halide exposed imagewise during shooting is developed by a first developer to a black-and-white negative. Metol-hydroquinone or phenidone-hydroquinone developers are generally used.

Intermediate washing=removal of the first developer to avoid redevelopment in the color development bath.

Diffuse second exposure or chemical fogging. All the silver halide which was not developed in the first developer is made developable.

Color development=development of the silver halide activated by the second exposure or chemical fogging to silver and dye formation. The dyes are formed in corresponding quantities from color coupler and the developer oxidation product formed proportionally to the silver halide reduced in the color developer.

Bleaching and fixing or bleaching/fixing=dissolving out all the silver developed in the first and color development to leave a positive dye image.

Final washing or stabilizing bath=washing out of chemicals and stabilizing of image dyes and image surface.

This reversal process could be made much easier, faster and more efficient if it were possible to eliminate the washing between first and color development and the diffuse second exposure or chemical fogging in a separate step. However, if the conventional process were to be carried out without the washing step, black-and-white redevelopment would occur through carryover of the first developer into the color developer in conjunction with the diffuse second exposure and would seriously affect the quality of the final dye image.

However, carryover of the first developer would be of little significance if it were comparable with the structure of the color developer and did not cause any secondary reactions in the color development bath.

If a color developer were to be used in the first and color development bath, carryover of the developer would not be a disadvantage in the absence of intermediate washing, although this developer would have to be suitable for black-and-white development (reduction of the exposed silver halide nuclei to image silver) in the first development bath, in addition to which there could be no coupling of the developer oxidation product formed with the color couplers in the photographic material.

DE-A-2 249 857 describes a reversal development process in which both a black-and-white developer and also a color developer inhibited in its color coupling activity are used in the first development bath. In a second bath, the coupling-inhibiting effects, produced for example by sulfite, ascorbic acid, etc., are eliminated so that color coupling can take place. However, the disadvantage of this process lies in the simultaneous presence of two types of developer and the resulting coordination and process difficulties. In overall terms, only moderate image quality is achieved.

Now, the problem addressed by the present invention was to provide a reversal development process in which washing between the first and color development bath and the diffuse second exposure are eliminated without any of the above-mentioned disadvantages arising.

The present invention relates to a photographic reversal process for the production of positive photographic images by imagewise exposure of the photosensitive material containing at least one silver halide emulsion layer, black-and-white first development of the material, chemical fogging, color development, bleaching, fixing, washing or stabilizing and drying, in which the material is transferred from the first development to the color development without any intermediate steps, such as intermediate washing or diffuse second exposure, the first development bath exclusively contains one or more N,N-dialkyl-p-phenylenediamine derivatives as developer and at least one tin(II) complex compound and is adjusted to a pH value of $<8$ and the color development bath likewise exclusively contains one or more N,N-dialkyl-p-phenylenediamine derivatives as developer and is adjusted to a pH value of $>10$.

Suitable developers of the p-phenylenediamine type correspond to the following general formula

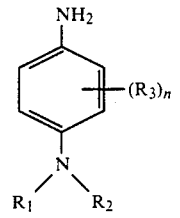

in which $R_1$, $R_2$ represent H, optionally substituted $C_{1-4}$ alkyl, $C_{6-10}$ aryl and $C_{1-3}$ alkoxy, $R_3$ represents H, optionally substituted $C_{1-4}$ alkyl, $C_{6-10}$ aryl and $C_{1-3}$ alkoxy, halogen, $n=1$ or 2.

Particularly suitable primary aromatic amino developers are p-phenylenediamines and, in particular, N,N-dialkyl-p-phenylenediamines in which the alkyl groups and the aromatic nucleus are substituted or unsubstituted. Examples of such compounds are N,N-diethyl-p-phenylenediamine hydrochloride, 4-N,N-diethyl-2-methyl phenylenediamine hydrochloride, 4-(N-ethyl N-2 methanesulfonylaminoethyl)-2-methyl phenylenediamine sesquisulfate monohydrate, 4-(N-ethyl-N-2-hydroxyethyl)-2-methyl phenylenediamine sulfate and 4-N,N-diethyl-2,2'-methanesulfonylaminoethyl phenylenediamine hydrochloride.

The concentrations of the developer compounds in the first development bath are in the range from 2 to 20 g/l and preferably in the range from 4 to 10 g/l.

In one preferred embodiment, no developer compounds are added to the second development bath, so that only the components carried over from the first development bath are present.

The first development bath preferably contains at least one compound which prevents the color coupler from reacting with the developer oxidation product.

Suitable compounds are, for example, citrazinic acid, sulfite, hydroxylamine and derivatives, ascorbic acid and derivatives and colorless couplers which produce a colorless coupling product (white couplers). They are preferably used in a quantity of 0.005 to 0.1 mol/l.

The concentration of the tin(II) complex compounds in the first development bath is from 0.001 to 0.05 mol/l.

Suitable complexing agents for the Sn(II) complex compounds are, in particular, carboxylic acids and phosphonic acids such as, for example, aminocarboxylic acids, such as for example ethylenediamine tetraacetic acid and those mentioned in DE-OS 1 814 834; hydroxycarboxylic acids, such as for example gluconic acid and citric acid; polycarboxylic acids, such as oxalic acid; phosphonic acids of the nitrilomethylene phosphonic acid and alkylidene phosphonic acid type, as mentioned for example in DE-OS 2 009 693, azacycloalkane-2,2-diphosphonic acids, of the type known from DE-OS 2 610 678, or phosphonocarboxylic acids containing at least one carboxy group and at least one phosphono group in the molecule, particularly acids corresponding to the following general formula:

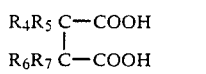

in which $R_4$, $R_5$, $R_6$, $R_7$ may be the same or different and represent hydrogen, $C_{1-4}$ alkyl, hydroxyl or $(CH_2)_mX$, where X may be a phosphono group or a carboxy group and m=0 or an integer of 1 to 4, with the proviso that at least one of the substituents $R_4$ to $R_7$ consists of, or contains, a phosphono group.

A particularly suitable phosphonocarboxylic acid is 1,2,4-tricarboxybutane-2-phosphonic acid. The complexing agents mentioned may be used individually or in combination and optionally in excess, based on the tin(II) ions present, in the baths to be used in accordance with the invention.

In another preferred embodiment, the first developer contains a phosphate or acetate buffer and is adjusted to a pH value of $<7$. In this case, there is no need for compounds which are intended to prevent the developer oxidation product from reacting with the color coupler.

In addition, in cases where this process is carried out continuously, it can be of advantage to add wetting agents and complexing agents to the two developer solutions to accelerate penetration of the solutions into the emulsion layers and to bind calcium ions from the gelatine and the water.

Suitable complexing agents for complexing calcium ions are, for example, aminopolycarboxylic acids which are well known per se. Typical examples of such aminopolycarboxylic acids are nitrilotriacetic acid, ethylenediamine tetraacetic acid (EDTA), 1,3-diamino-2-hydroxypropyl tetraacetic acid, diethylenetriamine pentaacetic acid, N,N'-bis-(2-hydroxybenzyl)-ethylenediamine-N,N'-diacetic acid, hydroxyethyl ethylenediamine triacetic acid, cyclohexanediaminotetraacetic acid and aminomalonic acid.

Other calcium complexing agents are polyphosphates, phosphonic acids, aminopolyphosphonic acids and hydrolyzed polymaleic anhydride, for example sodium hexametaphosphate, 1-hydroxyethane-1,1-diphosphonic acid (HEDP), aminotris methylene phosphonic acid, ethylenediamine tetramethylene phosphonic acid. 1-Hydroxyethane-1,1-diphosphonic acid also acts as a complexing agent for iron.

In addition, it is of advantage to add iron complexing agents to the two developer solutions.

Special iron complexing agents are, for example, 4,5-dihydroxy-1,3-benzenedisulfonic acid, 5,6-dihydroxy-1,2,4-benzenetrisulfonic acid and 3,4,5-trihydroxybenzoic acid.

To complex the calcium, it is preferred to use approximately 0.2 to approximately 1.8 mol of a calcium complexing agent per mol developer compound.

The iron complexing agent is used in quantities of from about 0.02 to about 0.2 mol per mol developer compound.

In addition, it may be appropriate to add whiteners and/or white couplers to the solutions.

Other suitable constituents include optical brighteners, lubricants, for example polyalkylene glycols, surfactants, stabilizers, for example heterocyclic mercapto compounds or nitrobenzimidazole and agents for establishing the desired pH value. In addition, the developer solution may contain less than 5 g/l benzyl alcohol, although it is preferably free from benzyl alcohol.

The ready-to-use solutions may be prepared from the individual constituents or from so-called concentrates in which the individual constituents are dissolved in much more highly concentrated form. The concentrates are formulated in such a way that a so-called regenerator may be prepared from them, i.e. a solution which has somewhat higher concentrations of the individual constituents than the ready-to-use solution, on the one hand by further dilution and addition of a starter, gives a ready-to-use solution and, on the other hand, is continuously added to an in-use developer solution to replace the chemicals consumed during development or displaced from the developer solution by overflow or by the developed material.

After development, the photographic material is bleached, fixed, washed and dried in the usual way; bleaching and fixing may be combined into a single bleaching/fixing step while washing may be replaced by a stabilizing bath.

Suitable color reversal materials are, in particular, color reversal photographic paper which is, in particular, a paper laminated with a baryta layer or, preferably, an α-olefin polymer layer (for example polyethylene), to which the photosensitive layers are applied.

The material normally contains at least one red-sensitive silver halide emulsion layer, at least one green-sensitive silver halide emulsion layer and at least one blue-sensitive silver halide emulsion layer and, optionally, intermediate layers and protective layers.

Binders, silver halide grains and color couplers are essential constituents of the photographic emulsion layers.

Gelatine is preferably used as binder although it may be completely or partly replaced by other synthetic, semisynthetic or even naturally occurring polymers. Synthetic gelatine substitutes are, for example, polyvinyl alcohol, poly-N-vinyl pyrrolidone, polyacrylamides, polyacrylic acid and derivatives thereof, particularly copolymers. Naturally occurring gelatine substitutes are, for example, other proteins, such as albumin or casein, cellulose, sugar, starch or alginates. Semisynthetic gelatine substitutes are generally modified natural products. Cellulose derivatives, such as hydroxyalkyl cellulose, carboxymethyl cellulose and phthalyl cellulose and also gelatine derivatives which have been obtained by reaction with alkylating or acylating agents or by grafting on of polymerizable monomers are examples of such modified natural products.

The binders should contain an adequate number of functional groups, so that sufficiently resistant layers can be produced by reaction with suitable hardeners. Functional groups of the type in question are, in particular, amino groups and also carboxyl groups, hydroxyl groups and active methylene groups.

The gelatine preferably used may be obtained by acidic or alkaline digestion. Oxidized gelatine may also be used. The production of such gelatines is described, for example, in The Science and Technology of Gelatine, edited by A.G. Ward and A. Courts, Academic Press 1977, pages 295 et seq. The particular gelatine used should contain as few photographically active impurities as possible (inert gelatine). Gelatines of high viscosity and low swelling are particularly advantageous.

The silver halide present as photosensitive constituent in the photographic material may contain as halide chloride, bromide or iodide and mixtures thereof. For example, 0 to 15 mol-% of the halide of at least one layer may consist of iodide, 0 to 100 mol-% of chloride and 0 to 100 mol-% of bromide. Preferred emulsions are silver bromide chloride emulsions containing, on the one hand, at least 80 mol-% bromide and 0 to 20 mol-% chloride and, on the other hand, at least 95 mol-% chloride and 0 to 5 mol-% bromide. The silver halide may consist of predominantly compact crystals which may have, for example, a regular cubic or octahedral form or transitional forms. However, the silver halide may also consist with advantage of platelet-like crystals of which the average diameter-to-thickness ratio is preferably at least 5:1, the diameter of a crystal being defined as the diameter of a circle with an area corresponding to the projected area of the crystal. However, the layers may also contain platy silver halide crystals in which the diameter-to-thickness ratio is considerably greater than 5:1, for example from 12:1 to 30:1.

The silver halide grains may also have a multiplelayer grain structure, in the most simple case with an inner and an outer core region (core/shell), the halide composition and/or other modifications such as, for example, doping of the individual grain regions being different. The average grain size of the emulsions is preferably between 0.2 μm and 2.0 μm; the grain size distribution may be both homodisperse and heterodisperse. A homodisperse grain size distribution means that 95% of the grains differ from the average grain size by no more than ±30%. In addition to the silver halide, the emulsions may also contain organic silver salts, for example silver benztriazolate or silver behenate.

Two or more types of silver halide prepared separately may be used in admixture.

The photographic emulsions may be spectrally sensitized using methine dyes or other dyes. Particularly suitable dyes are cyanine dyes, merocyanine dyes and complex merocyanine dyes.

A review of the polymethine dyes suitable as spectral sensitizers, suitable combinations thereof and supersensitizing combinations thereof can be found in Research Disclosure 17643/1978, Section IV.

The following dyes (in order of spectral regions) are particularly suitable:

1. as red sensitizers 9-ethylcarbocyanines with benzthiazole, benzselenoazole or naphthothiazole as basic terminal groups, which may be substituted in the 5- and/or 6-position by halogen, methyl, methoxy, carbalkoxy, aryl, and also 9-ethyl naphthoxathiaor selenocarbocyanines and 9-ethyl naphthothiaoxa- and benzimidazocarbocyanines, providing the dyes, contain at least one sulfoalkyl group at the heterocyclic nitrogen;

2. as green sensitizers 9-ethylcarbocyanines with benzoxazole, naphthoxazole or a benzoxazole and a benzthiazole as basic terminal groups and also benzimidazocarbocyanines which may also be further substituted and must also contain at least one sulfoalkyl group at the heterocyclic nitrogen;

3. as blue sensitizers symmetrical or asymmetrical benzimidazo-, oxa-, thia- or selenacyanines containing at least one sulfoalkyl group at the heterocyclic nitrogen and, optionally, other substituents at the aromatic nucleus and also apomerocyanines containing a thiocyanine group.

There is no need for sensitizers where the natural sensitivity of the silver halide is sufficient for a certain spectral region, for example the blue sensitivity of silver bromides.

Non-diffusing monomeric or polymeric color couplers are associated with the differently sensitized emulsion layers and may be arranged in the same layer or an in adjacent layer. Cyan couplers are normally associated with the red-sensitive layers, magenta couplers with the green-sensitive layers and yellow couplers with the blue-sensitive layers.

Color couplers for producing the cyan component dye image are generally couplers of the phenol or α-naphthol type.

Color couplers for producing the magenta component dye image are generally couplers of the 5-pyrazolone type, the indazolone type or the pyrazoloazole type.

Color couplers for producing the yellow component dye image are generally couplers containing an open-chain ketomethylene group, particularly couplers of the α-acyl acetamide type, of which suitable examples are α-benzoyl acetanilide couplers and α-pivaloyl acetanilide couplers.

EXAMPLE

A color photographic recording material suitable for the processing process according to the invention was prepared by application of the following layers in the order indicated to a layer support of paper coated on both sides with polyethylene. All the quantities shown are based on 1 $m^2$. For the silver halide applied the corresponding quantities of $AgNO_3$ are shown.

Layer Combination

2st Layer (substrate layer):
- 0.2 g gelatine

2nd Layer (blue-sensitive layer):
- blue-sensitive silver halide emulsion (99.5 mol-% chloride, 0.5 mol-% bromide, mean grain diameter 0.8 μm) of 0.63 g $AgNO_3$ containing
- 1.38 g gelatine
- 0.95 g yellow coupler Y
- 0.2 g white coupler W
- 0.29 g tricresyl phosphate (TCP)

3rd Layer (protective layer)
- 1.1 g gelatine
- 0.06 g 2,5-dioctyl hydroquinone 0.06 g dibutyl phthalate (DBP)

4th Layer (green-sensitive layer)

green-sensitized silver halide emulsion (99.5 mol-% chloride, 0.5 mol-% bromide, mean grain diameter 0.6 μm) of 0.45 g $AgNO_3$ containing 1.08 g gelatine 0.41 g magenta coupler M 0.08 g 2,5-dioctyl hydroquinone 0.5 g DBP 0.04 g TCP 5th Layer (UV-absorbing layer)

1.15 g gelatine 0.6 g UV absorber corresponding to the following formula

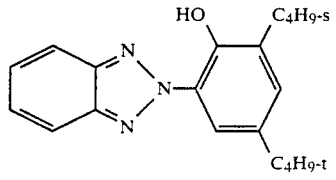

0.045g 2,5-dioctyl hydroquinone 0.04 g TCP

6th Layer (red-sensitive layer)

red-sensitized silver halide emulsion (99.5 mol-% chloride, 0.5 mol-% bromide, mean grain diameter 0.5 μm) of 0.3 g $AgNO_3$ containing 0.75 g gelatine 0.36 g cyan coupler C 0.36 g TCP 7th Layer (UV-absorbing layer)

35 0.35 g gelatine 0.15 g UV absorber as in 5th layer 0.2 g TCP

8th Layer (protective layer)

0.9 g Gelatine 0.3 g Hardener corresponding to the following formula

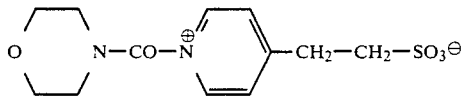

The components used have the following formulae:

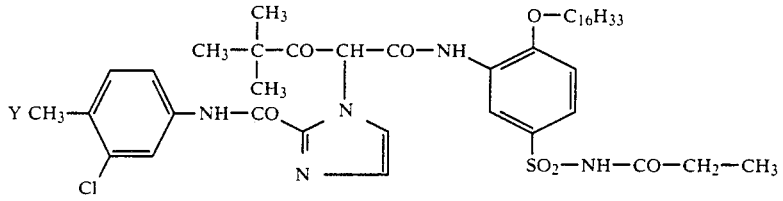

M

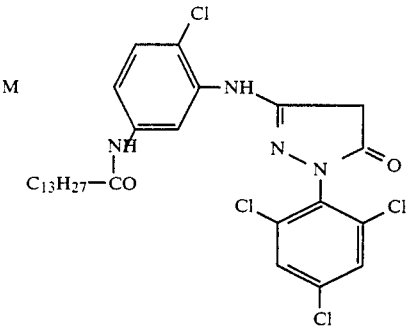

C

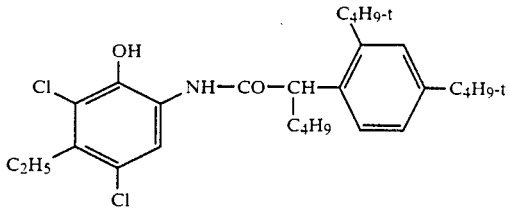

-continued

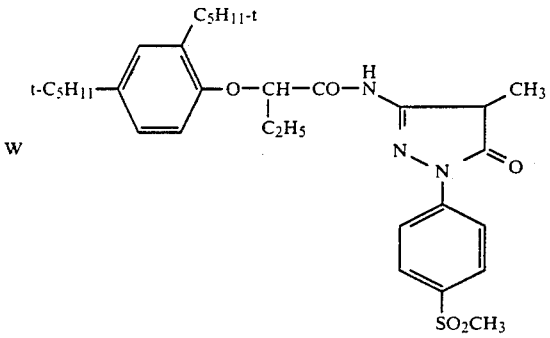

A step wedge is exposed onto the photographic recording material described above and processed as follows:

| | |
|---|---|
| First developer | 45 secs., 30° C. |
| Color developer | 45 secs., 30° C. |
| Bleaching/fixing | 45 secs., 30° C. |
| Washing (3 × 15 secs.) | 45 secs., 30° C. |
| Drying | |

The individual processing baths had the following composition:

| | |
|---|---|
| First Developer | |
| Water | 800 ml |
| 4-(N-ethyl-N-2-hydroxyethyl)-2-methyl-phenylenediamine sulfate monohydrate (CD 4) | 7 g |
| Sn(II) phosphonobutane tricarboxylic acid | 3.2 g |
| Sodium sulfite | 0.6 g |
| Citrazinic acid | 5 g |
| Potassium carbonate | 20 g |
| Adjust pH to 7.5, then make up with water to 1 liter. | |
| Second developer | |
| Water | 900 ml |
| EDTA | 2 g |
| HEDP, 60% by weight | 0.5 ml |
| Sodium chloride | 1 g |
| N,N-diethylhydroxylamine, 85% by weight | 5 ml |
| 4-(N-ethyl-N-2-methanesulfonylaminoethyl)-2-methyl phenylenediamine sesquisulfate monohydrate (CD 3), 50% by weight | 8 ml |
| Potassium carbonate | 25 g |
| Adjust pH to 11 with KOH or $H_2SO_4$ and make up with water to 1 liter. | |
| Bleaching/fixing bath: | |
| Water | 800 ml |
| EDTA | 4 g |
| Ammonium thiosulfate | 100 g |
| Sodium sulfite | 15 g |
| Ammonium-iron-EDTA complex | 60 g |
| 3-Mercapto-1,2,4-triazole | 2 g |
| Adjust pH to 7.3 with ammonia or acetic acid and make up with water to 1 liter. | |

COMPARISON EXAMPLE

The procedure is as in Example 1, except that 1. the first developer is used without the tin complex,
2. the material is washed for 60 seconds after the first developer
3. a second exposure is carried out, after which the material is processed as in Example 1.

Both processes produce substantially the same sensitometric results in regard to gradation, neutrality of coordination, maximum densities, whites and color purity.

According to the invention, the following first and second developers may also be successfully used:

| | |
|---|---|
| First Developer | |
| Water | 800 ml |
| CD 3 | 10 g |
| Sodium sulfite | 10 g |
| $KH_2PO_4$ | 20 g |
| Sn(II) ions (as complex compound) | 0.3–3 g |
| Adjust pH to 5.5–7.5 and make up with water to 1 liter. | |
| Second developer | |
| Water | 900 ml |
| $KH_2PO_4$ | 30 g |
| CD 3 | 0–5 g |
| Sodium sulfite | 0–5 g |
| Sn(II) ions (as complex compound) | 0–1 g |
| Adjust pH to 10–13 with KOH and make up with water to 1 liter. | |

In addition to phosphonobutane tricarboxylic acid, ethylene diamine tetraacetic acid, oxalic acid or gluconic acid may be used as complexing agents.

In addition, the second developer may contain typical development accelerators, such as ethylenediamine or thioether compounds.

We claim:

1. A photographic reversal process for the production of positive photographic images by imagewise exposure of a photosensitive material containing at least one silver halide emulsion layer and color couplers comprising the steps of black-and-white first development of said imagewise exposed photosensitive material in a first development bath comprised of (a) a developer consisting of one or more N,N-dialkyl-p-phenylene derivatives, (b) at least one tin (II) complex compound, and (c) at least one compound which prevents the color couplers from reacting with a developer oxidation product in the first development step, said first development bath having a pH value of less than 8, transferring said black-and-white developed material from said first development bath to a color development bath without any intermediate steps, color development of the black-and-white developed material in the absence of any intermediate steps in said color development bath containing a developer consisting of one or more N,N dialkyl-p-phenylenediamine derivatives at a pH value of greater than 10, and chemically fogging the material in said color development step in the presence of said tin (II) complex compound, and bleaching, fixing, washing or stabilizing and drying the developed photosensitive material.

2. A process as claimed in claim 1, characterized in that the N,N-dialkyl-p-phenylenediamine derivative in the first development bath corresponds to formula (II)

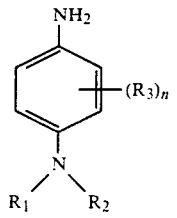

(II)

in which $R_1$ and $R_2$ represent H, optionally substituted $C_{1-4}$ alkyl, $C_{6-10}$ aryl and $C_{1-3}$ alkoxy, $R_3$ represents H, optionally substituted $C_{1-4}$ alkyl, $C_{6-10}$ aryl and $C_{1-3}$ alkoxy, halogen, n=1 or 2.

3. A process as claimed in claim 1, characterized in that the N,N-dialkyl-p-phenylenediamine derivatives correspond to the following two formulae

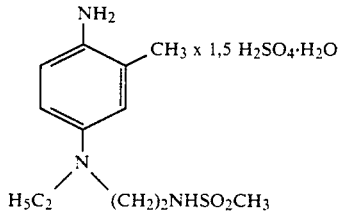

-continued

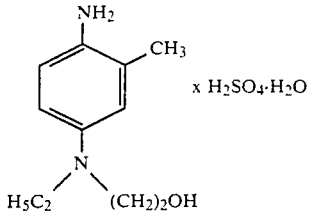

4. A process as claimed in claim 1, characterized in that the concentration of the developer compounds in the first development bath is in the range from 2 to 20 g/l.

5. A process as claimed in claim 1, characterized in that the concentration of the tin (II) complex compounds in the first development bath is in the range from 0.001 to 0.05 mol/l.

6. A process as claimed in claim 1, characterized in that carboxylic acids and phosphonic acids are used as complexing agents for the tin (II) complex compounds.

7. A process as claimed in claim 6, characterized in that the complexing compounds correspond to the following formula

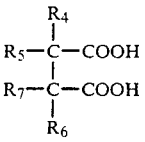

in which $R_4$, $R_5$, $R_6$, $R_7$ may be the same or different and represent hydrogen, $C_{1-4}$ alkyl, hydroxyl or $(CH_2)_mX$ where X may be a phosphono group or a carboxy group and m=0 or an integer of 1 to 4, with the proviso that at least one of the substituents $R_4$ to $R_7$ consists of or contains, a phosphono group.

8. A process as claimed in claim 1, characterized in that the at least one compound preventing the coupling reaction is used in a quantity of 0.005 to 0.1 mol/l.

* * * * *